United States Patent [19]

Gleim

[11] 4,155,833

[45] May 22, 1979

[54] SEPARATION OF TRUE ASPHALTENES FROM MICROCRYSTALLINE WAXES

[75] Inventor: William K. T. Gleim, Seattle, Wash.

[73] Assignee: Energy Modification, Inc., Gainesville, Fla.

[21] Appl. No.: 873,115

[22] Filed: Jan. 30, 1978

[51] Int. Cl.[2] ..... C10C 1/18; C10C 3/00

[52] U.S. Cl. ..... 208/45; 208/309

[58] Field of Search ..... 208/45, 309

[56] References Cited

U.S. PATENT DOCUMENTS

| | | | |
|---|---|---|---|
| 2,002,004 | 5/1935 | Gard | 208/14 |
| 3,303,122 | 2/1967 | Doelman | 208/45 |
| 3,360,455 | 12/1967 | Corbett et al. | 208/45 |
| 3,364,138 | 1/1968 | Campagne et al. | 208/45 |
| 3,476,679 | 11/1969 | Fauber | 208/45 |
| 3,563,778 | 2/1971 | Corbett et al. | 208/45 |
| 3,775,292 | 11/1973 | Watkins | 208/309 |
| 3,796,653 | 3/1974 | Gatsis | 208/309 |
| 4,069,141 | 1/1978 | Lionetti et al. | 208/309 |

*Primary Examiner*—Veronica O'Keefe
*Assistant Examiner*—Lillie Richardson
*Attorney, Agent, or Firm*—Philip T. Liggett

[57] ABSTRACT

A more efficient separation of the asphaltenes from microcrystalline waxes in the bottoms from crude oil distillation is accomplished by using a natural gasoline fraction, boiling in the range of from 200°–400° F., as a solvent extraction agent and then effecting a centrifugal separation at elevated temperatures and pressures. The resulting separated asphaltenes will have far less microcrystalline wax content than the heretofore used procedures which involved the settling out of the asphaltenes in huge settling tanks.

7 Claims, 2 Drawing Figures

SEPARATION OF TRUE ASPHALTENES FROM MICROCRYSTALLINE WAXES

This invention is directed to a more efficient procedure for separating heat labile asphaltenes from the microcrystalline waxes in order to preclude obtaining undesirable high quantities of the waxes in the asphaltene fraction.

More particularly, the present invention is directed to a procedure which utilizes a centrifugal action to separate the fractions of a mixture of asphaltenes, solvent and microcrystalline waxes. Typically, the less adulterated "true" asphaltenes will be centrifuged out of the mixture at temperatures ranging from 100°-200° C., at a pressure of from 2 to about 10 atmospheres.

As a result, the present process will make a better usage of the residues from curde oil distillation by virtue of permitting relatively complete and economical conversion of most crude oils to the production of less, but better, asphaltenes, while at the same time effecting the separation of greater quantities of the microcrystalline waxes that can be cracked or otherwise converted to valuable distillate. In another aspect, it is also especially desirable to provide a process which can treat residue materials to remove the heat labile asphaltenes so that the resulting stream can be charged to a hydrodesulfurization unit without having excess coke forming fractions and metal residues to affect the catalysts of the desulfurizing units, while simultaneously effecting in such units a much higher degree of desulfurization.

BACKGROUND OF THE INVENTION

It is generally known that the use of straight vacuum residue for road asphalt produces a road cover of inferior quality from the standpoint of durability because the paraffin components of the vacuum residues are readily biologically degradable. In time the asphalt cover loses its coherence and becomes brittle.

As a result, various deasphalting processes have been developed in order to obtain a more paraffin-free asphaltic product. The deasphalting process, in general, consists of extracting the waxes from the asphaltenes. The "asphaltenes" are defined as materials which are insoluble in pentane or heptane, but soluble in benzene. The asphaltene materials are also considered to be "heat labile," in that they coke readily at temperatures above about 700° F. Typically the solvents used in "deasphalting" operations to separate the waxes from the asphaltenes are propane and mixtures of propane, butane and pentane.

It has, however, recently been determined that the various groups of compounds making up these mixtures called "asphaltenes" still contain up to 50% microcrystalline waxes. This discovery came to light from a new analytical method designed to analyze recovered asphaltenes and reference may be made to: A.P.I. Research Project 60, Report No. 13, "Characterization of the Heavy Ends of Petroleum," July 1, 1972, to June 30, 1973. In essence, it appears that the high percentage (up to 50%) of microcrystalline waxes remains because they are soluble in heptane at its boiling point of about 100° C. while only soluble to a small extent at ambient temperatures. In the standard asphaltene test, where there is testing with pentane or heptane at ambient temperatures, the microcrystalline waxes are practically insoluble in the solvent and tend to simulate asphaltenes and will to some degree co-precipitate with them.

By way of comparison, the new method of asphaltene component analysis demonstrates that the so-called asphaltenes, as determined by insolubility in heptane, actually consist of about 50% microcrystalline waxes, on the average. This, in turn, means that the asphaltene percentages previously published in the literature for crude oil, as to atmospheric distillation residues and vacuum distillation residues, should be cut by about fifty percent.

Although there are less asphaltenes, i.e., "true" asphaltenes, in crude oils than heretofore reported, it is to be emphasized that the asphaltenes recovered in an improved separation procedures will be less adulterated; and, as a result, not subjected to the rapid deterioration of the mixes which contain up to 50% waxes. In addition, it is to be pointed out that a better separation of the waxes provides a greater field of material suitable as a valuable source of distillate. Asphaltenes cannot be cracked to distillate. Where they are left in distillate cuts, they mostly form gas and coke, causing difficulties in the refining operations. Actually, as heretofore noted, the presence of the heat labile materials prevents the total desulfurization of the residual fuels in the present-day catalytic hydrodesulfurization units. The commercial desulfurization of residual fuels containing asphaltenes achieves a reduction of the sulfur content to no better than 0.2% to 0.3% while the same residual fuel can be desulfurized to less than 0.01% sulfur provided the true asphaltenes are removed. Furthermore, catalyst life can be extended from one year to about eight years.

SUMMARY OF THE INVENTION

It may be considered a principal object of the present invention to effect a separation procedure which results in obtaining what may be referred to as the true asphaltenes free of microcrystalline waxes in the resulting asphaltene fractions.

It is a further object of the present invention to use a centrifugal force separation procedures such that there is a more rapid and less cumbersome over-all process as compared to the more conventional settling types of operations which require large volumes of solvent and huge settling tanks.

It has been noted that certain centrifugal separation operations have been used, or at least taught as being of advantage in connection with a crude before an atmospheric and vacuum distillation to remove a substantial portion of the wax content; however, it is not known that any prior work has been done with regard to the present process where the centrifugal separation is carried out in the presence of the wax solvent at elevated temperatures, i.e., in a range of from about 100° C. to about 200° C. and while the pressure is superatmospheric, i.e., up to about 10 atmospheres, depending upon mechanical aspects.

A still further object resides in providing a process resulting in charge stocks which can be utilized for introduction into a catalytic hydrodesulfurizer to in turn provide sulfur-free fuel oil or can be cracked to produce greater quantities of gasoline.

In one embodiment, the present invention provides an improved method for maximizing the separation of the heat labile fraction of asphaltenes in the residue of crude oil distillation, which comprises the steps of:

(a) adding a solvent for the wax content of said residue, (b) effecting a mixing of said solvent and said residue and providing a centrifuging action of the combined stream in a confined pressure-tight centrifuging zone at a temperature in the range of about 100° C. to about 200° C. while at an elevated pressure at least sufficient to maintain the solvent material in a liquid state, whereby to separate the heavier heat labile asphaltene fraction from the mixture, and (c) affecting the withdrawal of the asphaltene fraction from the centrifuging zone separate from the resulting mixture of residue and solvent materials.

In another embodiment, the invention provides a method for obtaining an improved, more concentrated asphaltene cut from the residue of a crude oil distillation by adding a suitable microcrystalline wax solvent to such residue and effecting a mixing thereof followed by a centrifugal separation stage all carried out at an elevated temperature in the range of from about 100° C. to about 200° C., and at an elevated pressure of from about 2 to 10 atmospheres, and then affecting a recovery of the resulting asphaltenes from the solvent and microcrystalline wax materials.

In still other embodiments, a desired processing operation will affect the separation of the solvent fraction from the waxes and provide for recycling at least a portion of such solvent fraction to provide for admixture with the crude residue being introduced into the centrifugal separation zone.

In order to point out still further advantages resulting from the present invention, it should be noted that not only does the presence of microcyrstalline waxes in an asphalt component make an inferior road cover material, there is the corollary aspect in that the presence of asphaltenes in oil can cause great difficulties in the refining operations. More specifically, while the asphaltenes cannot be easily cracked, as has herein before set forth, and will cause harmful coke formation, it is also to be again pointed out that the "asphaltene materials" have a high content of sulfur, oxygen, and nitrogen which will lead to rapid catalyst deactivation in catalytic cracking units. On the other hand, as here above set forth, the asphaltenes when free of paraffinic components can produce superior road cover materials.

Actually from the aspect of processing operations, it should be of considerable nationwide advantage if a more economical separation process is provided the oil industry so as to yield more distillate materials and less, but better, asphaltenes.

DESCRIPTION OF THE DRAWING

In order to better explain the present improved separation process, as well as assist in setting forth advantages there from, reference may be made to the accompanying drawing and the following description thereof.

Figure 1:
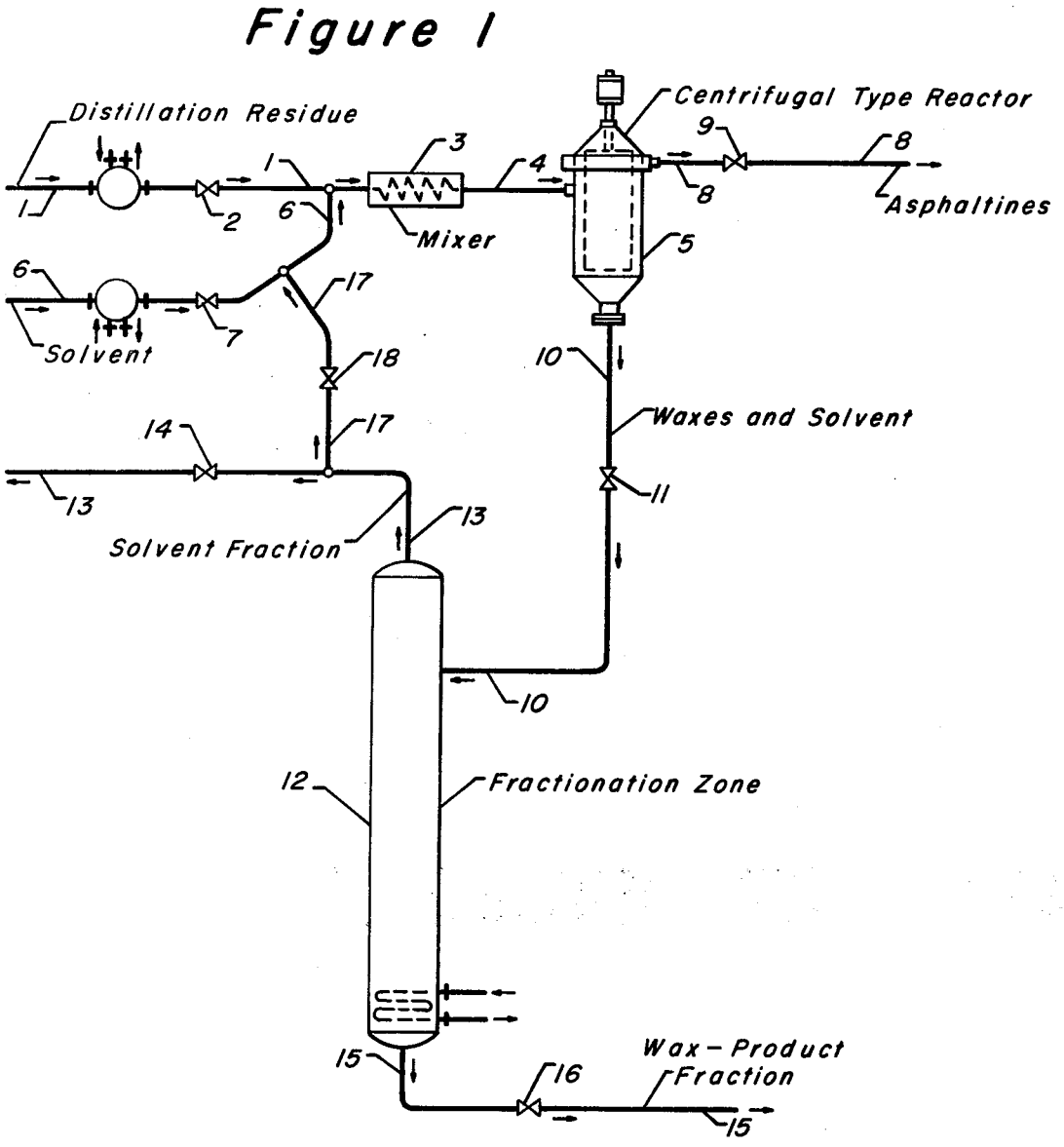
FIG. 1 is a diagrammatic drawing showing a process flow embodying the present invention.

Referring now particularly to FIG. 1 of the drawing, there is diagrammatically shown a charge line 1, with control valve 2, providing means to introduce a typical residue stream, such as from crude oil distillation equipment, into a premixing zone 3, and then through line 4 into a centrifuging type of reactor unit 5. In addition, there is also shown a line 6, with valve 7, connecting to the charge line 1 so as to provide for the mixing of a suitable solvent into the charge stream and into the mixer 3 and thence to the centrifuging reactor 5. The solvent stream as heretofore noted, will typically comprise propane or a mixture of propane, butane and pentane so as to primarily effect the removal of the microcrystalline waxes from the crude residue. Actually, in the present process, the solvent may typically comprise a natural gasoline cut that should be available in most refineries with a boiling range of 50° C. to 200° C., a density of not more than about 0.75 and a vapor pressure of not more than about 10 atmospheres at a temperature of 200° C. The solvent should dissolve all the oil-soluble materials but not the oil-insoluble, colloidally dispersed material, namely the asphaltenes.

The mixing and centrifuging in the respective units 3 and 5 is carried out at temperatures ranging from 100° C. to 200° C. and at a pressure above atmospheric up to a pressure not exceeding about 10 atmospheres, or to the general limits of the centrifuge. Up until recent times suitable types of centrifuges were not available to effect the desired processing conditions. However, at the present time, a mechanical decanter type of unit which can operate at elevated pressures and temperatures are known to be available such as from the Escher-Wyss Co. of Switzerland and from the Kraus-Maffei Co. of West Germany.

The mixer unit 3 is indicated diagrammatically as a baffled static mixer; however, it is not intended to limit the present operation to the use of any one type of mixer since various types of units, including mechanically agitated mixers may well be used to advantage. In other instances, line mixing together with the mixing in the centrifugal reactor unit may be sufficient.

The centrifuge, operating under the proper conditions, will serve to discharge the heavier asphaltene stream by way of an upper line 8, with valve 9, separate and apart from the wax-solvent stream which, in this instance, is shown as being discharged from lower line 10, through valve 11, to a separation zone 12. The latter is shown as a fractionator type of unit providing for the overhead removal of a solvent fraction by way of line 13 with valve 14 and the bottoms withdrawal of a wax fraction by way of line 15 and control valve 16.

In addition there is shown the provision of a line 17 from line 13 which will provide for the controlled recycle, by way of valve 18, of at least a portion of the solvent stream into line 6 and back to the mixing-centrifuging section of the overall processing unit. The indicated scheme is, of course, diagrammatic and variations in the equipment may well be incorporated, as for example, a plurality of separation-fractionator means may be used if desired, in lieu of the single vessel unit 12, in order to obtain the desired separation of the solvent stream. For simplicity, pumps, heaters, instruments, etc., are not shown in the drawing.

Figure 2:
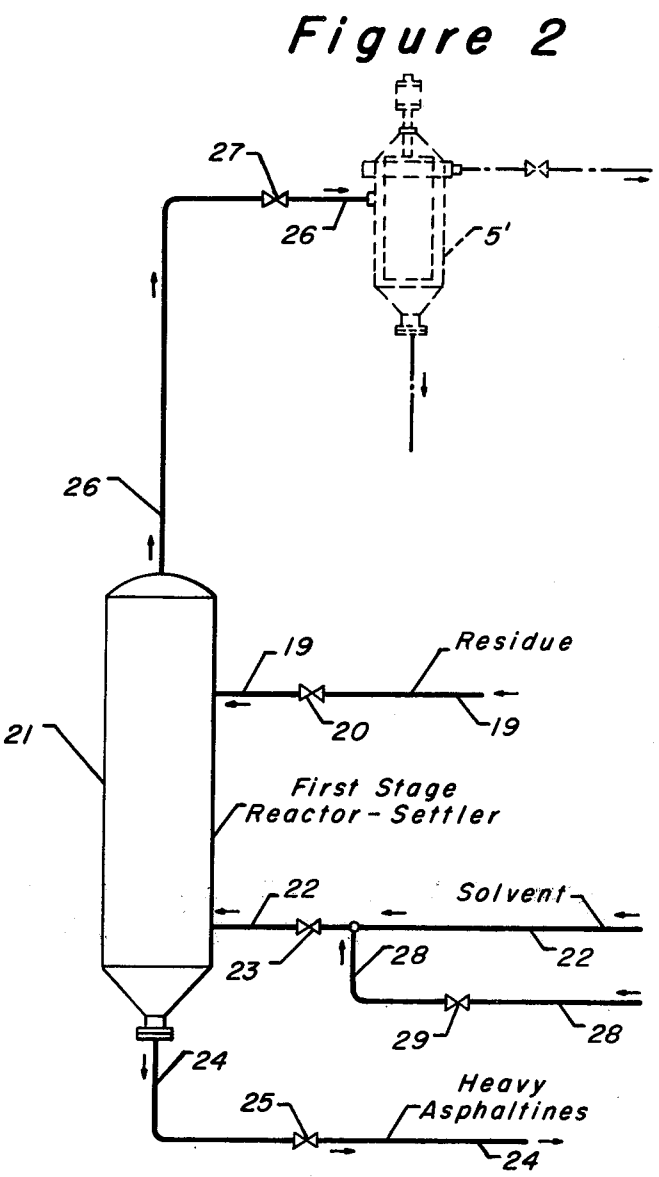
FIG. 2 is a modification of the process flow of FIG. 1 to the extent that an initial reactor-settler is utilized ahead of the centrifugal reactor.

As an alternative operation, as best shown in FIG. 2 of the drawing, there is indicated the introduction of the heated crude residue through line 19 and control valve 20 to a first stage reactor-setter 21. There is also shown, at a lower level, the introduction of the solvent stream by way of line 22 and valve 23. Preferably the tower 21 will have a diameter-to-height ratio of from about 1:5 to about 1:10.

The heaviest asphaltenes will settle to the bottom of the reactor, where they can be withdrawn by way of line 24 and control valve 25. The lighter asphaltenes, suspended in the solvent are carried to the top of the reactor 21 and then the entire overhead stream would be carried by way of line 26 and valve 27 to a centrifuging reactor 5 to be processed in the same manner as the teachings of FIG. 1 of the drawing. Recycled solvent could also be added to line 22 from a line 28 and valve 29.

It is to be understood that the drawings are diagrammatic and that still other modifications may be utilized as to types of mixing, centrifuging, fractionating, etc. as well as arrangement of zones. All pumps, other valving, instrumentation, etc., as required by conventional refinery construction has also been eliminated from the drawing in order to simplify the presentation.

In this modified process it is again the function of the overall operation to remove the heat labile, coke forming, materials so that a better charge stock for fuel is made and/or a better separation is provided in obtaining improved road asphalts, etc.

In order to illustrate the advantages of the improved type of processing operation, the following examples are set forth to show the more desirable resulting product streams.

EXAMPLE I

Into a reactor chamber, embodying a pressure-tight centrifuge of the mechanical decanter type which can operate at elevated pressures and temperatures, is fed a 150° C. vacuum tower bottoms stream of 8.8° API gravity and containing 6.0% asphaltenes (according to the standard ASTM test method) and 100 ppm of metal, primarily nickel and vanadium. In addition, heptane is mixed with said bottoms stream and fed to the reactor at a temperature of about 150° C., in an amount providing two volumes of a heptane solvent to one volume of the bottoms stream. The centrifuging of the resulting mixture is carried out at an elevated pressure sufficient to insure maintaining the heptane in a liquid state at the 105° C. temperature.

The resulting product stream will have the asphaltenes reduced to the order of 3%, as determined by the standard ASTM test method for asphaltenes, while the metals content will be reduced to the order of 40 ppm.

EXAMPLE II

In a centrifugal reactor as described for Example I, a vacuum bottoms stream of 6.2 API gravity and containing 13.3% asphaltenes and 480 ppm of nickel and vanadium is treated with two volumes of a solvent comprising a natural gas liquid fraction boiling between 100° C. and 200° C. The mixed stream at about 175° C., and under an elevated pressure sufficient to keep the solvent in a liquid state within the centrifugal reactor results in a product stream where the asphaltenes are of the order of 6.0% by the standard ASTM test method, and the metals content reduced to 150 ppm.

EXAMPLE III

A bottoms stream, from what is generally referred to as a "Boscan crude," with a 16.2% asphaltenes content and a 1450 ppm nickel and vanadium metals content, when treated with two volumes of n-heptane for solvent, under conditions such as set forth in Example I, will result in a product stream with only about 8.0% asphaltenes as determined by the standard ASTM test method and a 480 ppm metals content.

EXAMPLE IV

In the heating of an Athabasca tar sand bitumen extract, which contains 12.8% asphaltenes, 1.4% clay and 270 ppm metals (primarily nickel and vanadium) with a solvent stream comprising only one volume of a natural gas liquid cut (boiling between 100° C. and 125° C.) at a temperature of the order of 170° C., and at an elevated pressure to keep the solvent liquid in a centrifugal reactor of the type described in Example I, there will be a resulting product stream where the asphaltenes will be only of the order of 7.0%, by the standard ASTM test method, while the metals will be about 90 ppm and the clay substantially all removed.

By the foregoing examples, it can be noted that the centrifuging operation will provide highly improved product streams while utilizing quite small amounts of solvent materials as compared to the older and conventional settling processes.

It is to be further noted that the present method of operation does not limit itself to merely using "wax solvents" of $C_3$, $C_4$, and $C_5$ or mixtures thereof, but can include hexane and heptane, or, as shown in the examples, may comprise natural gas cuts. The solvent will typically dissolve the wax content but only a minimum of the coke-forming asphaltenes type materials.

Also with regard to modifications in charge materials, it may be pointed out that liquid hydrocarbonaceous products, or partially liquified products, obtained from solid carbonaceous materials, such as coal, may well be subjected to the same type of operations as set forth herein to in turn obtain better separation procedures.

I claim as my invention:

1. An improved method for maximizing the separation of the heat labile fraction of asphaltenes in the residue of crude oil distillation, which comprises the steps of:

(a) adding a solvent for the wax content of said residue, (b) effecting a mixing of said solvent and said residue and providing a subsequent pressurized centrifuging action of the combined stream in a confined pressure-tight powered centrifuging zone at a temperature in the range of about 100° C. to about 200° C. while at an elevated pressure at least sufficient to maintain the solvent material in a liquid state, whereby to separate the heavier heat labile true asphaltene fraction from the mixture, and (c) effecting the withdrawal of the highly wax-free true asphaltene fraction from the centrifuging zone separate from the resulting mixture of residue from solvent materials.

2. The method of claim 1 further characterized in that the residue and solvent streams are premixed prior to introduction to the centrifuging zone.

3. The method of claim 2 still further characterized in that the premixing is effected in a static mixer.

4. The method of claim 2 still further characterized in that the premixing is effected in a vertical column providing a presettlement and withdrawal of heavy asphaltenes from the bottom thereof and an overhead discharge of the lighter asphaltenes with the solvent to be carried to the centrifuging zone.

5. The method of claim 1 further characterized in that the mixture of solvent and soluble residue from the centrifuging zone is subjected to suitable fractionation at suitable conditions to obtain a solvent fraction and a fraction substantially free of heat labile asphaltene materials and at least a portion of the solvent fraction is recycled to combine with the residue charge stream ahead of the centrifuging zone.

6. The method of claim 1 further characterized in that the solvent stream is a natural gasoline fraction with a boiling range of from about 50° C. to 200° C.

7. The method of claim 1 further characterized in that the pressurized centrifugal action in maintaining said solvent material in a liquid state while at an elevated temperature of up to about 200° C. may in turn be up to the order of 10 atmospheres to thereby reduce the wax content of asphaltene fraction.

* * * * *